US008494119B2

(12) United States Patent
Andersson

(10) Patent No.: US 8,494,119 B2
(45) Date of Patent: Jul. 23, 2013

(54) RADIATION WINDOW, AND A METHOD FOR ITS MANUFACTURING

(75) Inventor: Hans Andersson, Vantaa (FI)

(73) Assignee: Oxford Instruments Analytical Oy, Espoo (FI)

( * ) Notice: Subject to any disclaimer, the term of this patent is extended or adjusted under 35 U.S.C. 154(b) by 237 days.

(21) Appl. No.: 12/818,500

(22) Filed: Jun. 18, 2010

(65) Prior Publication Data

US 2011/0311029 A1 Dec. 22, 2011

(51) Int. Cl.
*G21K 1/00* (2006.01)

(52) U.S. Cl.
USPC ..... 378/161; 378/145

(58) Field of Classification Search
USPC ..... 378/161, 145
See application file for complete search history.

(56) References Cited

U.S. PATENT DOCUMENTS 4,939,763 A 7/1990 Pinneo et al.
2008/0317209 A1* 12/2008 Sipila et al. ..... 378/140
2009/0310742 A1* 12/2009 Kim et al. ..... 378/38
2010/0126660 A1* 5/2010 O'Hara ..... 156/249
2012/0025110 A1* 2/2012 Davis et al. ..... 250/505.1

FOREIGN PATENT DOCUMENTS

WO WO 96/21235 7/1996
WO WO 2009/158553 12/2009

OTHER PUBLICATIONS

Extended European Search Report and European Search Opinion dated Dec. 2, 2011 on European Patent Application No. EP 11170266.8.

* cited by examiner

*Primary Examiner* — Hoon Song

(74) *Attorney, Agent, or Firm* — Woods, Phillips, Katz, Clark & Mortimer

(57) ABSTRACT

A radiation window membrane and for covering an opening in an X-ray device is presented, as well a method for its manufacturing. Said openings are such through which X-rays are to pass. The membrane comprises a window base layer and a pinhole-blocking layer on a surface of said window base layer. Said pinhole-blocking layer comprises graphene.

14 Claims, 3 Drawing Sheets

RADIATION WINDOW, AND A METHOD FOR ITS MANUFACTURING

TECHNICAL FIELD

The invention concerns in general the technology of radiation windows used to cover openings that must allow X-rays pass through.

BACKGROUND OF THE INVENTION

X-ray tubes, gas-filled X-ray detectors and various other applications require window materials applicable to sealing an opening in a gastight manner, while still letting X-rays of at least some desired wavelength range pass through the window with as little attenuation as possible. Another requirement for the window material is its ability to stand a certain amount of mechanical stress, because the pressure difference between the different sides of the window may be considerable.

In this description we use the terms "film" and "foil" to mean a thin material layer of uniform thickness, and the term "membrane" to mean generally a structure that is relatively thin, i.e. has a very small overall dimension in one direction compared to its dimensions in the other, perpendicular dimensions. A membrane may consist of several materials and may have significant local variations in its thickness, and may exhibit structural topology, such as reinforcement ridges. Additionally we use the term "layer" to mean a thin amount of material, which does not necessarily need to be continuous or even but which consists of essentially a single constituent. A "mesh" is a special case of a layer, in which intentional discontinuities exist usually in the form of a regular matrix of openings.

Films and membranes for radiation windows can be manufactured in various ways. One commonly used material is beryllium, from which high-quality films as thin as 8 micrometers can be manufactured by rolling. On a base membrane various additional layers can be produced using thin film manufacturing techniques such as sputtering or chemical vapor deposition. A drawback of known membranes for radiation windows is the possible appearance of pinholes, which are microscopic discontinuities in an otherwise continuous material layer. Pinholes may allow gas to leak through, which causes contamination of gas-filled enclosures with unwanted gaseous substances as well as degradation of intended overpressure or vacuum environments.

SUMMARY OF THE INVENTION

An objective of the present invention is to present a radiation window membrane that does not suffer from the disadvantages related to pinholes. Another objective of the invention is to present a method for manufacturing pinhole-free radiation free membranes.

The objectives of the invention are achieved by using a graphene layer next to a window base layer, so that the graphene layer blocks pinholes that may exist in the window base layer.

According to a first aspect of the invention, a radiation window membrane is provided for covering an opening in an X-ray device, through which opening X-rays are to pass, and the membrane comprises a window base layer and a pinhole-blocking layer on a surface of said window base layer, which pinhole-blocking layer comprises graphene.

According to a second aspect of the invention, a method is provided for manufacturing a radiation window membrane for covering an opening in an X-ray device, through which opening X-rays are to pass. The method comprises attaching a pinhole-blocking layer to a window base layer, wherein said pinhole-blocking layer comprises graphene.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION AND ITS EMBODIMENTS

Figure 1:
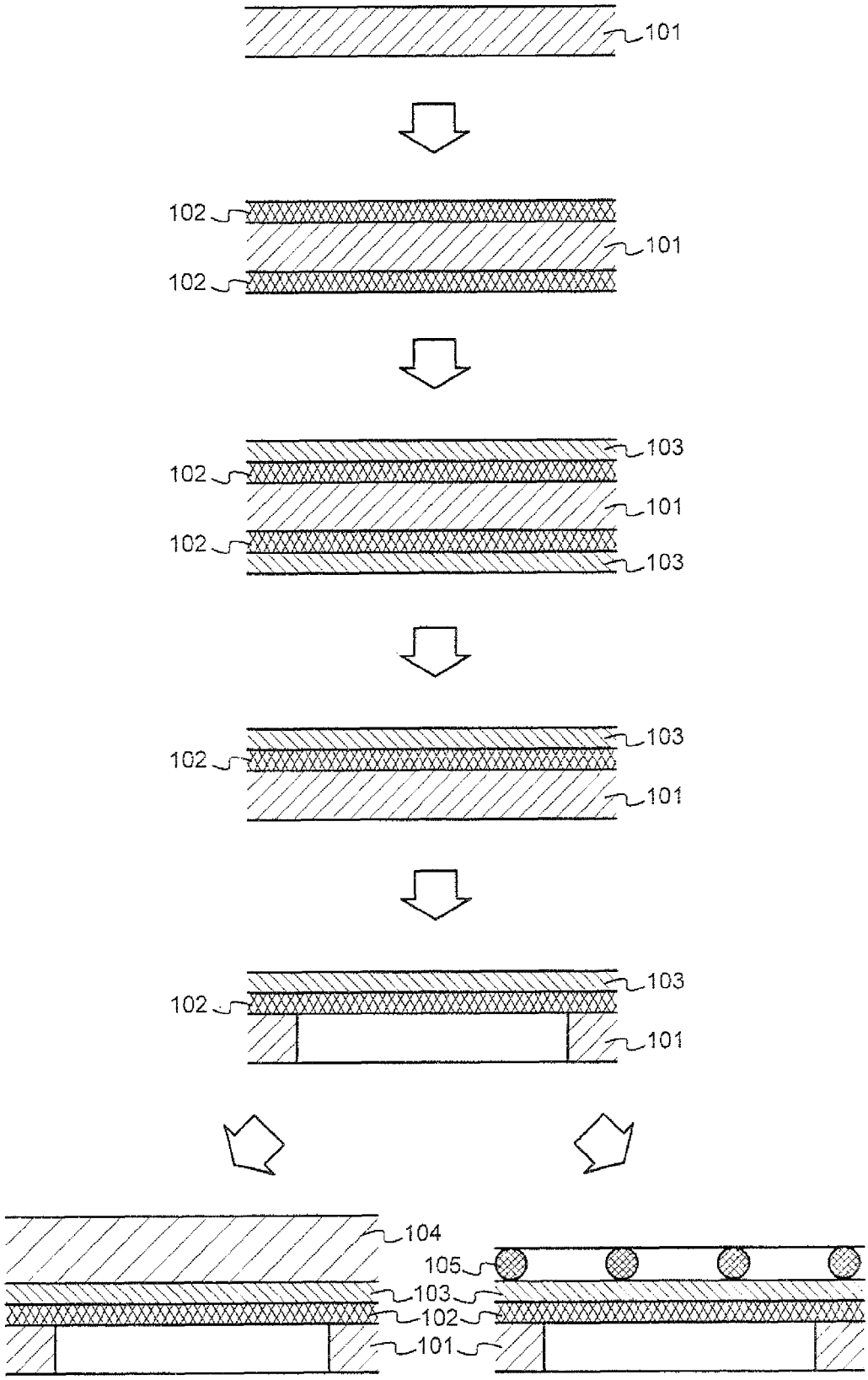
FIG. 1 illustrates a method for manufacturing a radiation window membrane according to an embodiment of the invention.

FIG. 1 illustrates certain steps in a method for manufacturing a radiation window membrane according to an embodiment of the invention. The radiation window membrane is meant to cover an opening in an X-ray device, through which opening X-rays are to pass.

At the topmost step in FIG. 1 there is provided a support layer 101, which is made of etchable material. This means that the material of the support layer 101 can be conveniently etched with some etching agent that is readily available and easily usable in a manufacturing process. The support layer 101 may be for example a copper or nickel foil, the thickness of which is some (tens of) micrometres. One exemplary value for the thickness of a copper foil used as an etchable support layer is 25 micrometres.

At the second step in FIG. 1 a thin film manufacturing technique is used to produce a layer 102 on the etchable support layer 101. Referring to its task later in the completed radiation window membrane, we may designate the layer 102 as the pinhole-blocking layer. An advantageous material for the pinhole-blocking layer 102 is graphene, which according to the definition of grapheme consists of one (or more) sheet-like grid(s) of sp2-bonded carbon atoms. In all embodiments of the invention the pinhole-blocking layer comprises graphene, for which reason we may designate this layer also as the graphene layer. Due to the extraordinary properties of graphene, the pinhole-blocking layer 102 may be as thin as one atomic layer. The invention does not restrict it from being thicker.

Using the conventional terminology on this field, a thin film manufacturing technique may mean any of a large variety of techniques in which the thin material layer is deposited or "grown"; in other words, it is not manufactured by making an originally thicker workpiece thinner. Depending on the selected technique, the graphene layer 102 may be produced either on only one side of the etchable support layer 101 or on its both sides. Here we assume that the selected thin film manufacturing technique was e.g. chemical vapour deposition (CVD), which typically produces a graphene layer 102 on both sides of the etchable support layer, unless its production on the other side is specifically prevented. Other thin film manufacturing techniques could be used as well, for example atomic layer deposition (ALD).

At the third step in FIG. 1 a thin film manufacturing technique is used to produce a window base layer 103 on the graphene layer(s) 102. Here we again assume that the selected technique was CVD, and consequently there appears a window base layer 103 next to both graphene layers 102 that were produced in the previous step, but this is not a requirement of the invention; in both steps also only one layer could be produced as long as the produced layers are next to each other. An exemplary material for the window base layer(s) 103 is aluminium oxide $Al_2O_3$. Other suitable materials are for example aluminium nitride AlN, titanium oxide $TiO_2$, and silicon nitride, for which several stoichiometric ratios are known and which is consequently often expressed chemically as $SiN_x$. The material for the window base layer 103 should be selected so that it has advantageous X-ray transmission properties and it can be made to have good tensile strength and other mechanical properties despite being relatively thin. Producing a window base layer with a thin film manufacturing technique tends to cause pinholes, but now the graphene layer is there and will act as a pinhole-blocking layer that blocks any pinholes that were possibly created in the window base layer.

If needed, a temporary support layer could be attached to the membrane that is built at this stage (after producing the window base layer(s)). Producing a temporary support layer is not shown in FIG. 1, but it could take the form of e.g. a spin-coated polymer layer on top of the membrane shown in the third step of FIG. 1.

At the fourth step of FIG. 1, the superfluous, lower window base layer and graphene layer are removed. This can be accomplished with any suitable method, for example grinding. Thus in the fourth step of FIG. 1 the etchable support layer 101 is exposed from below.

Depending on whether it is of any use, the etchable support layer 101 can thereafter be completely removed by etching it away, or parts of it may be made to remain. For the latter alternative, standard lithographic methods can be used so that only selected areas of the etchable support layer 101 are etched away. The fifth step of FIG. 1 illustrates a membrane where a central opening has been etched through the etchable support layer 101. A sandwich structure of the window base layer 103 and the pinhole-blocking layer 102 spans the opening.

Concerning the final structure of the radiation window membrane as such, the layers deposited in the second and third steps in FIG. 1 could have been reversed, i.e. so that on the etchable support layer 101 there had first been produced the window base layer(s) 103 and only thereafter the graphene-comprising pinhole-blocking layer(s) 102. In the radiation window membrane shown in the fifth step of FIG. 1, what has now become the patterned copper layer 101 is on one side of the pinhole-blocking layer 102 while the window base layer 103 is on the other. If the layers had been deposited in the reversed order in the second and third steps, the radiation window membrane would now have the patterned copper layer on one side of the window base layer, while the pinhole-blocking layer would be on the other. What has been said about a patterned copper layer can be generalised by using the designation "patterned layer", which can be e.g. a patterned copper layer, a patterned nickel layer, a patterned iridium layer, or a patterned ruthenium layer.

However, several reasons speak in favour of the preferred order explained above in association with FIG. 1. Graphene has relatively good resistance to etching, at least if the etching agent is selected suitably, which means that the order of the layers shown in FIG. 1 has the inherent advantage that the upper graphene layer works also as the etch stop layer. The etching agent used to etch away the central portion of the etchable support layer 101 will not reach the upper window base layer 103. Additionally, at least at the time of writing this description, it is believed that using a thin film manufacturing technique to produce a graphene layer is much easier if the surface on which the graphene layer is grown consists of a suitable metal, such as for example copper, nickel, iridium, or ruthenium. These and some other metals have been observed to have a some kind of catalytic function in the generation of a regular sheet-like grid of sp2-bonded carbon atoms on their surface in a thin film manufacturing process. Another possible explanation to their advantageousness is the poor or non-existing solubility of carbon to the materials in question. The invention does not limit the selection of a support layer material, as long as it has the desired characteristics for growing the appropriate layer onto its surface.

The two alternatives shown at the bottom of FIG. 1 illustrates adding a stiffer base, also called a support layer, to the membrane. The support layer can be a continuous film, such as a polymer film 104, or it could be a film with openings or a mesh of wires 105. One possibility of attaching a reinforcement mesh as a support layer to the membrane is the use of a positive-working photosensitive polymer, which has been described in detail in the patent publication U.S. Pat. No. 7,618,906, which is incorporated herein by reference. It is not necessary to actually attach the support layer to the membrane, if the support layer can be placed close enough and on that side of the radiation window membrane where it can act as a support against which the radiation window membrane may lean under the resultant force created by the pressure differences on its different side during use.

Figure 2:
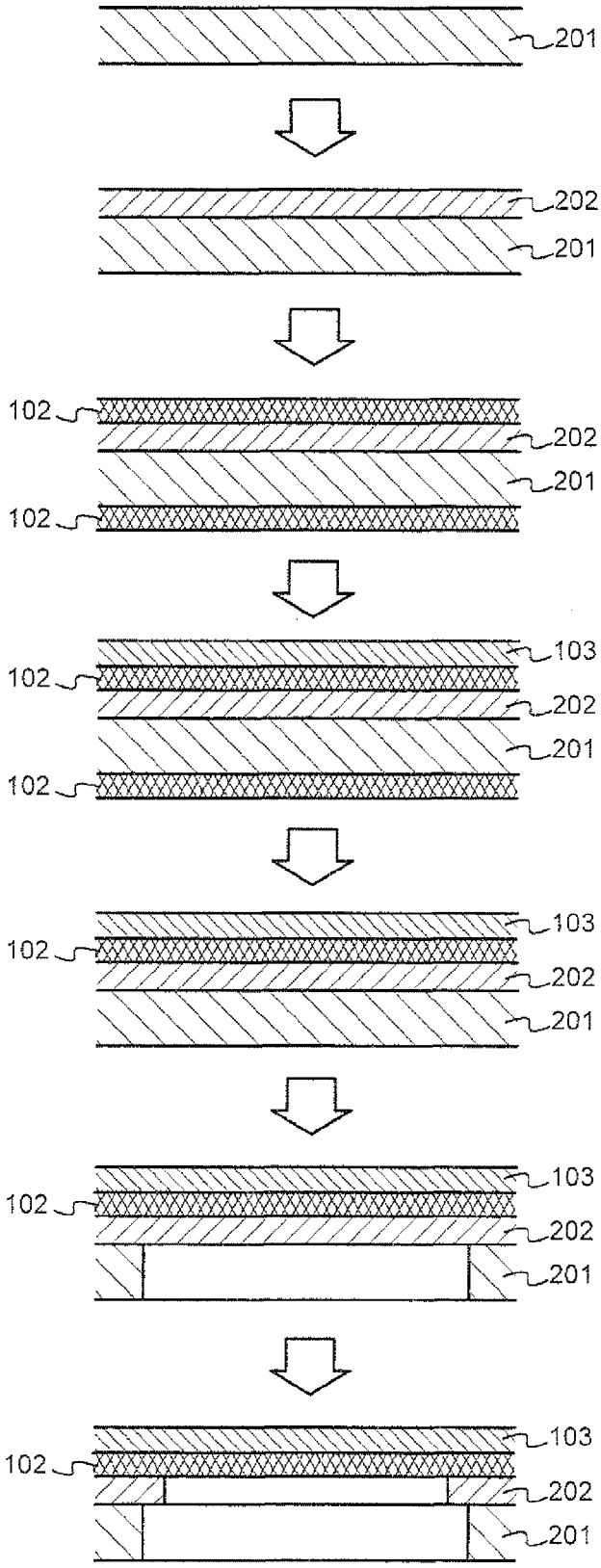
FIG. 2 illustrates a method for manufacturing a radiation window membrane according to another embodiment of the invention.

The method illustrated in FIG. 1 started from the support layer 101, so consequently it relies on the properties (smoothness, tensile strength, etc.) of the support layer being good enough. FIG. 2 illustrates a variation of the method, in which some of these requirements can be loosened. Here the starting point is a substrate 201, which can be e.g. a semiconductor wafer. Considering some later steps in the manufacturing process it is advantageous if also the substrate 201 is etchable, for which reason it can be called an etchable substrate layer.

On at least one surface of the etchable substrate layer, an etchable support layer 202 is produced by using a thin film technique. Using a well polished substrate and a thin film technique for depositing the etchable support layer 202 means that the surface smoothness and some other properties of the etchable support layer 202 may now be better than those of the etchable support layer in FIG. 1, even if the etchable support layer 202 may also in this case be made of copper.

The third step of FIG. 2 resembles the second step of FIG. 1 in that again, pinhole-blocking layers 102 containing graphene are produced on both sides of the membrane preform using a thin film manufacturing technique. In the fourth step of FIG. 2 a window base layer 103 is produced, this time by using a thin film manufacturing technique that only produces a layer on one side of the structure. Also in this case an advantageous material for the window base layer 103 is aluminium oxide, aluminium nitride, titanium oxide, silicon nitride, or any other material that has the desired absorption characteristics and mechanical properties of a window base layer. If any pinholes are left in it, they will be blocked by the pinhole-blocking (graphene) layer 102.

In the fourth step of FIG. 2 the lower graphene layer is removed much like the removal of the lower window base layer and lower graphene layers in the fourth step of FIG. 1 earlier. Etching through both the etchable substrate layer 201 and the etchable support layer 202 are shown at the remaining two steps of FIG. 2 respectively. Here it is assumed that the etching is performed in two different steps, resulting in a slightly differently patterned copper layer 202 next to the pinhole-blocking (graphene) layer 102 than what is the patterning of the etchable substrate layer 201. This is not a requirement of the invention, and the two layers could be etched through also in a single method step and with a similar pattern in both. In many cases the etchable substrate layer 201 is removed altogether, and a copper layer 202 is made patterned only if its patterns can be utilized for example as a mechanical support grid.

Figure 3:
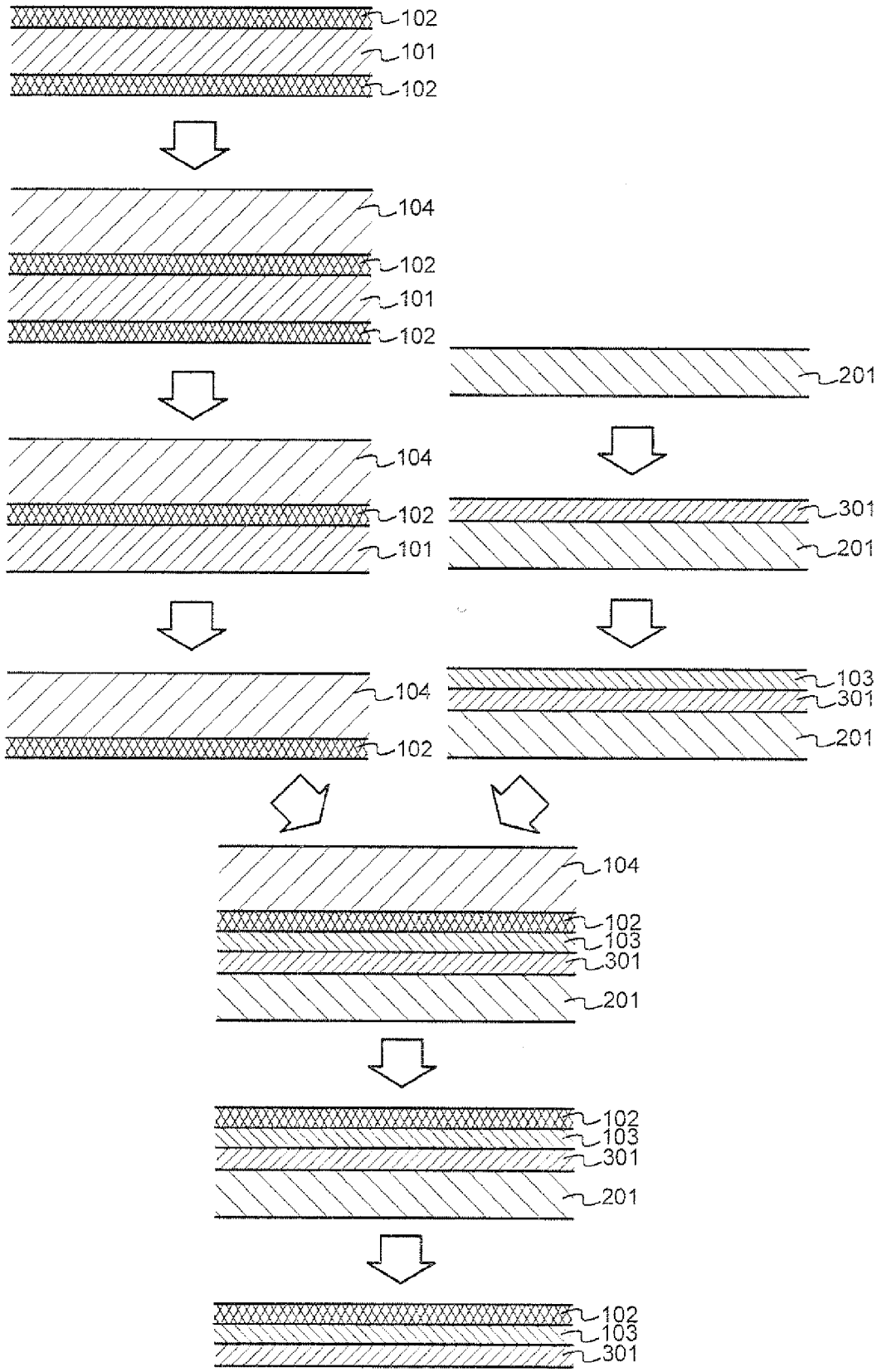
FIG. 3 illustrates a method for manufacturing a radiation window membrane according to yet another embodiment of the invention.

FIG. 3 illustrates yet another method for manufacturing a radiation window membrane according to an embodiment of the invention. This time the preparation of a pinhole-blocking layer takes place in isolation from preparing the window base layer, until it becomes time to attach these two together. At the top left in the upper part of FIG. 3 the step of producing pinhole-blocking (graphene) layers 102 on both sides of a support layer 101 is shown, resembling very much the second step of FIG. 1 earlier. In this case the support layer 101 is a first support layer, because the next step comprises producing a second support layer 104 on a different surface of said pinhole-blocking (graphene) layer than said first support layer. The second support layer 104 be e.g. a thermal release tape, which will later on act as a temporary carrier for the upper graphene layer.

In the two following steps on the left in FIG. 3 the lower graphene layer and the first support layer are subsequently removed. Because of their technical properties, different methods can be applied to remove the two layers: for example, the lower graphene layer may be removed by grinding, while the first support layer 101 can be etched away. The result of the fourth step on the left in FIG. 3 is a first membrane, which comprises an exposed graphene layer.

In the meantime on the right at the upper part of FIG. 3 there was produced a second membrane. It comprises a substrate layer 201, which is for example a semiconductor wafer. On its one surface there was produced first an etch stop layer 301, which can be made of e.g. silicon nitride, and thereafter a window base layer 103, which may be for example an aluminium oxide layer. The result is a second membrane, which comprises an exposed window base layer. Thin film manufacturing techniques can be used for producing both the etch stop layer 301 and the window base layer 103.

At the middle part of FIG. 3 where the two branches combine, the first and second membranes are attached together so that the exposed graphene layer comes next to the exposed window base layer. Attaching the two together may be accomplished by any attaching means. In a simple embodiment of the invention the attachment does not need anything else than pressing the two together e.g. in a nip between rollers, so that the inherent adhesion between the window base layer 103 and the graphene layer 102 cause them to stick together. The second support layer 104 is removed, which is also particularly simple if the second support layer was a thermal release tape, because simply warming the membrane sufficiently will remove the second support layer. The warming could be combined with the nip mentioned above by heating at least one of the rollers that constitute the nip.

In another embodiment of the invention, glue could be used to attach the graphene layer to the window base layer, if it can be ensured that glue will only be applied to those areas that will not be in the radiation beam in the completed product. Glue could e.g. circumvent the opening area through which X-rays will eventually pass.

The etchable substrate layer 201 is removed by etching; the effect of the etching agent will stop at the etch stop layer 301.

The principle of using a stiffer support, which was schematically illustrated in the two alternatives at the very bottom of FIG. 1, can be combined also to radiation window membranes according to any of FIG. 2 or 3. Also the principle of etching away only part of a support layer, thus leaving a patterned support layer of some kind in the radiation membrane, can be used in association with the method steps shown in FIGS. 2 and 3.

We claim:

1. A radiation window membrane for covering an opening in an X-ray device, through which opening X-rays are to pass, the membrane comprising:

a window base layer, and a pinhole-blocking layer on a surface of said window base layer;

wherein said pinhole-blocking layer comprises graphene.

2. A radiation window membrane according to claim 1, wherein said pinhole-blocking layer is electrically conductive.

3. A radiation window membrane according to claim 1, wherein said window base layer comprises at least one of: aluminium oxide, aluminium nitride, titanium oxide, silicon nitride.

4. A radiation window membrane according to claim 3, comprising a patterned layer on one side of said pinhole-blocking layer, wherein said patterned layer is one of the following: a patterned copper layer, a patterned nickel layer, a patterned iridium layer, a patterned ruthenium layer.

5. A radiation window membrane according to claim 4, wherein said pinhole-blocking layer is on one side of said patterned layer, and the radiation window membrane comprises a patterned substrate on another side of said patterned layer.

6. A radiation window membrane according to claim 3, comprising an etch stop layer on a different side of said window base layer than said pinhole-blocking layer.

7. A radiation window membrane according to claim 1, wherein the radiation window membrane comprises additionally a support layer, which is one of: a continuous polymer film, a support mesh made of polymer, a support mesh made of metal.

8. A method for manufacturing a radiation window membrane for covering an opening in an X-ray device, through which opening X-rays are to pass, the method comprising:

attaching a pinhole-blocking layer to a window base layer;

wherein said pinhole-blocking layer comprises graphene.

9. A method according to claim 8, comprising:

using a thin film manufacturing technique to produce a graphene layer on an etchable support layer, wherein said graphene layer constitutes said pinhole-blocking layer, using a thin film manufacturing technique to produce a window base layer on said graphene layer, and etching through said etchable support layer to leave a patterned support layer on one side of said graphene layer.

10. A method according to claim 9, comprising:

before producing the graphene layer, using a thin film manufacturing technique to produce said etchable support layer on an etchable substrate layer, and in said etching step, etching through both the etchable substrate layer and said etchable support layer.

11. A method according to claim 8, comprising:

producing a first membrane, which comprises an exposed graphene layer, producing a second membrane, which comprises an exposed window base layer, and attaching said first membrane to said second membrane, so that said exposed graphene layer becomes attached to said exposed window base layer.

12. A method according to claim 11, wherein:

producing said first membrane comprises using a thin film manufacturing technique to produce said graphene layer on a first support layer, producing a second support layer on a different surface of said graphene layer than said first support layer, and removing the first support layer to expose said graphene layer.

13. A method according to claim 11, wherein:

producing said second membrane comprises using a thin film manufacturing technique to produce an etch stop layer on a substrate, and using a thin film manufacturing technique to produce said window base layer on said etch stop layer.

14. A method according to claim 13, wherein:

producing said first membrane comprises using a thin film manufacturing technique to produce said graphene layer on a first support layer, producing a second support layer on a different surface of said graphene layer than said first support layer, and removing the first support layer to expose said graphene layer, after attaching said first membrane to said second membrane, the method comprises removing at least part of said second support layer and at least part of said substrate.

* * * * *